United States Patent [19]

Kifer

[11] Patent Number: 4,936,605

[45] Date of Patent: Jun. 26, 1990

[54] CONTINUOUS BILLING AND ITINERARY DOCUMENT ASSEMBLY

[76] Inventor: Mark Kifer, P.O. Box 29746, Dallas, Tex. 75229

[21] Appl. No.: 286,274

[22] Filed: Dec. 19, 1988

[51] Int. Cl.[5] ..... B41L 1/20

[52] U.S. Cl. ..... 282/12 R; 282/11.5 A; 282/11.5 R; 282/9 R

[58] Field of Search ..... 282/11.5 A, 11.5 R, 282/12 R, 9 R; 229/70

[56] References Cited

U.S. PATENT DOCUMENTS

| | | | |
|---|---|---|---|
| 3,877,728 | 4/1975 | Herz | 282/11.5 R |
| 4,002,356 | 1/1977 | Weidmann | 282/8 R |
| 4,113,281 | 9/1978 | Halse | 282/11.5 A |
| 4,213,639 | 7/1980 | Absler et al. | 282/11:5 R |
| 4,342,472 | 8/1982 | Heimann et al. | 282/11.5 A |
| 4,375,382 | 3/1983 | Steidinger | 282/11.5 A |
| 4,493,496 | 1/1985 | Kaluza | 282/11.5 |

*Primary Examiner*—Hien H. Phan
*Assistant Examiner*—Thomas Hamill, Jr.
*Attorney, Agent, or Firm*—Robert G. Boydston

[57] ABSTRACT

A multilayered document assembly for travel agencies yields a customer's invoice, itinerary and document jacket as well as the agency's file copy by carbonless or carbon means of copying through the assembly. A document pocket is transversely disposed across an end of a lower sheet of the assembly to allow graphic area for printing all output information from common major airline computer program reservation and ticketing systems with no unused areas to result in waste paper to be disposed of by the agency employee. Standard size, relatively narrow paper can be utilized for the assembly sheets at considerable savings of paper expense over wider paper. Printers designed for maximum paper width of ten inches can utilize the assembly.

7 Claims, 2 Drawing Sheets

CONTINUOUS BILLING AND ITINERARY DOCUMENT ASSEMBLY

BACKGROUND OF THE INVENTION

This invention relates to continuous forms that receive computer generated information from computer controlled printing devices. The continuous form assembly of the invention, particularly useful in the travel industry, includes invoice and itinerary information sheets plus an information carrying document jacket overlayed for simultaneous imprinting during a single pass through a printer.

Travelers on commercial carriers today may need passage tickets, boarding passes, travel vouchers, itineraries, reservations for hotels and automobiles, tickets and reservations for meals and events and even other documents and information. Travel agencies service the needs of travelers by obtaining or generating the necessary tickets and other documents and preparing printed itineraries for the travelers. Most modern travel agencies subscribe to and are "on-line" with one or more of the computer operated reservation systems provided by certain major air line companies. The computer program of such systems accept, in addition to air travel information, hotel and automobile reservations and other data, all of which can printed out to create a complete traveler's itinerary.

A travel agent may spend an inordinate amount of time obtaining, preparing, organizing and packaging the documents and information for a customer's journey. Packaging usually entails the agent placing the various documents into a separate ticket jacket, envelope or other small document pouch and sometimes stapling documents to the jacket, envelope or pouch. Handwriting or typing onto the jacket, envelope or pouch may be required to provide the traveler with full information regarding the journey and/or the enclosed documents.

Reduction of the time spent and materials consumed for the various steps for generating and packaging the documents for each traveler is desired for travel agency labor cost control and efficiency. One continuous form assembly addressed to that need is the "Continuous Form Multiple Ply Assembly", U. S. Pat. No. 4,493,496. That assembly provides for simultaneous generation of some documents and a document folder on continuous form paper rolls or fanfolds of at least 13" width with a document folder formed by longitudinally folding the bottom sheet.

It is, therefore, an object of this invention to provide an improved document assembly for computer directed printing of information simultaneously on several sheets that include a sheet foldable to form a document holding jacket. It is another object of the invention to provide such a document assembly in narrow roll or fanfold continuous form configuration to miminize paper size and to reduce paper waste. A further object is to reduce travel agency employee labor required to generate, assemble and package travel documents. It is also an object of the invention to lessen the number of separate supply items required to be stocked by a travel agency to provide and package travel documents for travelers. Other objects and advantages will be apparent in the following summary and description of the invention.

SUMMARY OF THE INVENTION

A document assembly comprised of three or more sheets of paper material, typically four sheets for most travel agency uses, are arranged one on top of the other for continuous roll or fanfold feeding through a computer printer. A single row of pinfeed holes along each longitudinal edge of the assembly registers the sheets in the printer paper drive mechanism and provides for continuous feeding of one assembly after another. Separable margins containing the pinfeed holes are created along each longitudinal edge by perforations through each sheet of the assembly. Successive document assemblies are separable from one another by lateral perforations through the sheets where each assembly ends and the following assembly begins. Paper crimps sequentially spaced along each margin hold the sheets of the assemblies in place so long as the margins remain attached.

The bottom sheet of the assembly may be of heavy weight paper for strength because this sheet forms the body of a document holding jacket. The layer or sheet next to the bottom sheet is laterally perforated approximately one third of the longitudinal distance from an end and glued to the bottom sheet along the end edge and one side edge of the shorter panel separated from the balance of the sheet by the perforation. Removal of the unglued portion of the sheet by tearing at the perforated line leaves the glued portion to form a pocket, opened on an end and a side, transversely disposed across an end area of the bottom sheet. All sheets are constructed of self-encapsulated carbonless paper stock, such as "NCR" paper to provide for transfer of information from the top sheet to all lower sheets during the printing action.

Removal of the pinfeed margins frees the separate sheets of an assembly that has been separated from the preceding and succeeding assemblies at the lateral perforations. The separate sheets, including the jacket forming bottom sheet, carry whatever name, address, invoice itinerary or other information that the printer has placed on the assembly. Typically, the sheets would be preprinted with standard graphics making, for example, the top sheet an invoice, the second sheet an agent's copy, the third sheet portion removed at the lateral perforation an extra itinerary and the bottom sheet an itinerary page in the two-thirds area of the sheet not covered by the one-third panel received from the third sheet. The bottom sheet will have two lateral folding score lines for precise, rapid trifolding of the sheet into a document jacket for securely packaging a traveler's itinerary, tickets and other documents.

Disposition of the pocket part of the document jacket transversely across the bottom sheet of the assembly allows for use of less expensive, narrower rolls or fanfolds of continuous form paper because extra sheet width for longitudinal disposition of the pocket part beside an itinerary graphic area is not required. The line printing of the commonly used programs is limited to seven inch wide lines, and the use of wider paper for the bottom sheet to provide for a document folder is not necessary as it is where a pocket is formed longitudinally on the bottom sheet. The sheet length of continuous form paper between lateral perforations is usually eleven inches and by utilizing this dimension in the manner of the invention, a width of nine to ten inches, including pinfeed margins on each edge, is sufficient to accommodate all of the printed information. All paper of each sheet is utilized so there is no waste of tear off spacing pieces between successive assemblies.

The following detailed description of a specific embodiment more completely describes the features and advantages of the invention.

DESCRIPTION OF THE PREFERRED EMBODIMENT

Figure 1:
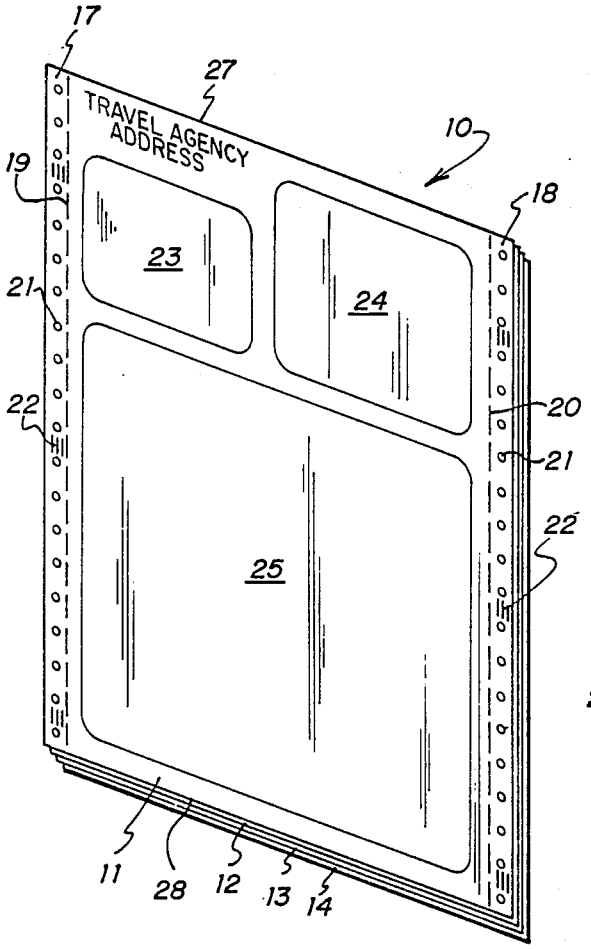
FIG. 1 is a perspective view of a multilayered continuous billing and itinerary document assembly.
Figure 2:
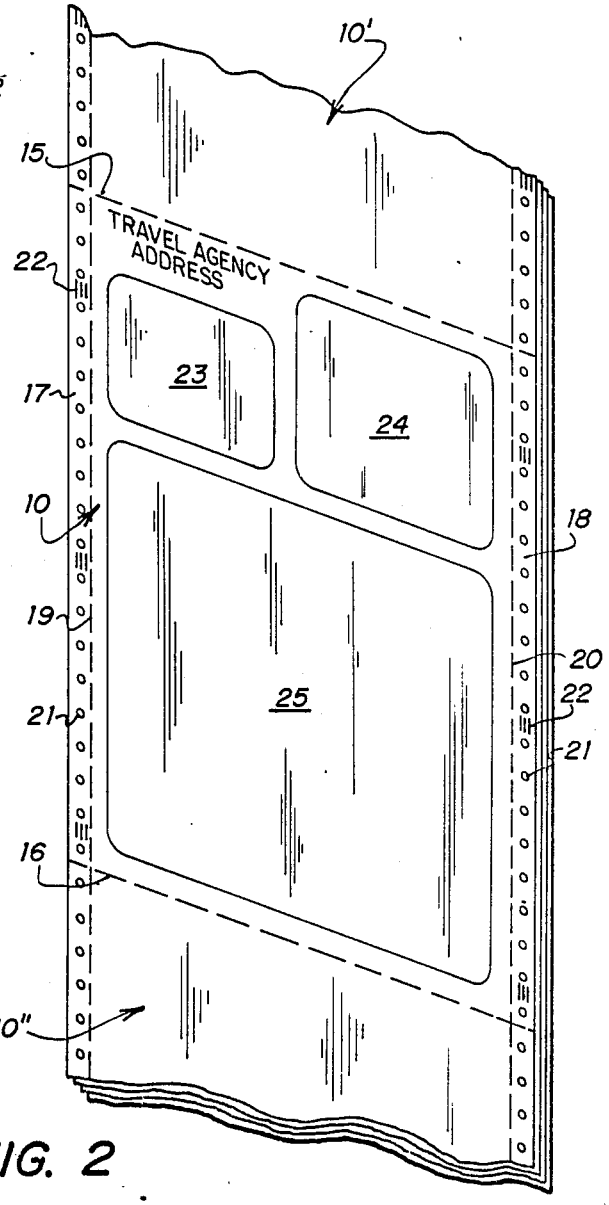
FIG. 2 is a perspective view of such a multilayered document assembly as a part of a continuous form roll of like assemblies.

The multilayered continuous billing and itinerary document assembly 10 is shown in FIG. 1 as having four sheets 11, 12, 13 and 14 in a typical, preferred embodiment of the invention. The same assembly 10 is depicted in FIG. 2 prior to separation from a continuous roll or fanfold of like assemblies 10' and 10''. a lateral line 15 of through perforations marks the end of assembly 10' and the beginning of assembly 10 and provides for easy manual separation of the assemblies. A like lateral perforation line 16 marks the end of assembly 10 and the beginning of assembly 10'' and provides for easy manual separation along such line 16.

Longitudinal through perforation lines 19 and 20 form a left pinfeed margin 17 and right pinfeed margin 18, respectively, and provide for manual separation of the assembly 10 from the margins 17 and 18. A multiplicity of regularly spaced pinfeed drive holes 21 through each margin 17 and 18 provide for engagement of the margins by the driving mechanism of a computer printer (not shown) to feed a succession of assemblies 10', 10 and 10'' through the printer. A succession of paper crimps 22 in each margin 17 and 18 holds the several sheets forming the assemblies 10, 10' and 10'' together in alignment.

Graphic areas 23, 24, and 25 on the top sheet 11 are typically delineated by preprinting of outlines and headings on the top sheet 11 and on preceding and succeeding like top sheets prior to collating the continuous roll or fanfold (not shown) to form the succession of multilayered assemblies 10', 10 and 1041 . Computer programs for airline reservations and ticketing used by travel agencies typically provide for printing a billing name and address in graphic area 23, the name or names of the person or persons traveling in graphic area 24 and complete itinerary information in graphic area 25. Such computer programs are typically arranged for seven inch wide lines of type across the receiving sheet 11 and printing of no more than eight inches of lines in the longitudinal direction of graphic area 25. Thus the document assembly 10 is suited to sheets 11, 12, 13 and 14 having lateral dimensions of eight to nine inches after detachment of the pinfeed margins 17 and 18 and longitudinal dimensions of approximately eleven inches.

While the description of the invention has focused on use of the document assembly 10 to receive information from a computer controlled printer, it should be understood that a document assembly could also be inserted into a typewriter for imparting the same type of invoice and itinerary information. Information typed or printed on the face of the top sheet 11 is simultaneously transferred below to sheets 12, 13 and 14 by the use of carbonless (although the same result could be obtained by using plain paper sheets with carbon sheets between layers or by using carbon backed sheets), self-encapsulated paper of which "NCR paper" is typical. The top sheet 11 may be a standard weight, coated back type of self-encapsulated paper and the interior second and third sheets 12 and 13 may be standard weight, coated front and back paper. The bottom sheet 15 may be of a heavier weight, such as 33 pound paper, coated on the front only.

Figure 3:
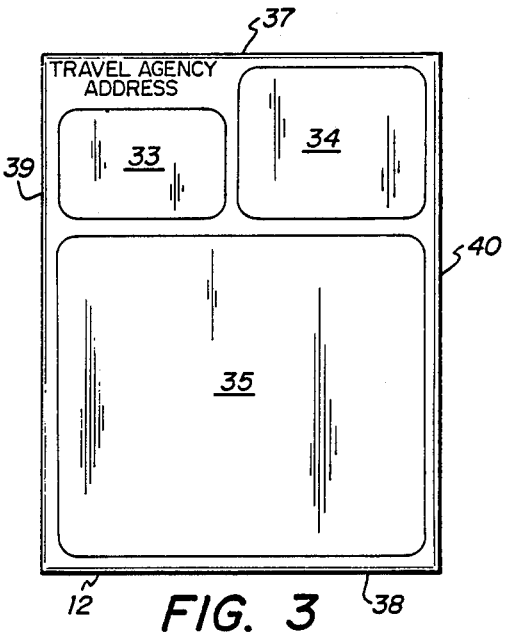
FIG. 3 is a plan view of the top face of the layer or sheet lying immediately behind the top sheet in FIG. 1.

Second sheet 12 is shown in FIG. 3 as having designated graphic areas 33, 34 and 35 corresponding to the graphic areas 23, 24 and 25 of top sheet 11. The sheet has been separated from the preceding and succeeding continuous form assemblies and from the pinfeed margins by tearing at the perforation lines as described above for the document assembly 10. This sheet 12, imprinted with full customer information, may be used for the agency's file or any other Purpose. If more such sheets are needed by a particular agency the document assembly 10 could be a five or six part assembly by simply including more interior sheets similar to second sheet 12.

Figure 4:
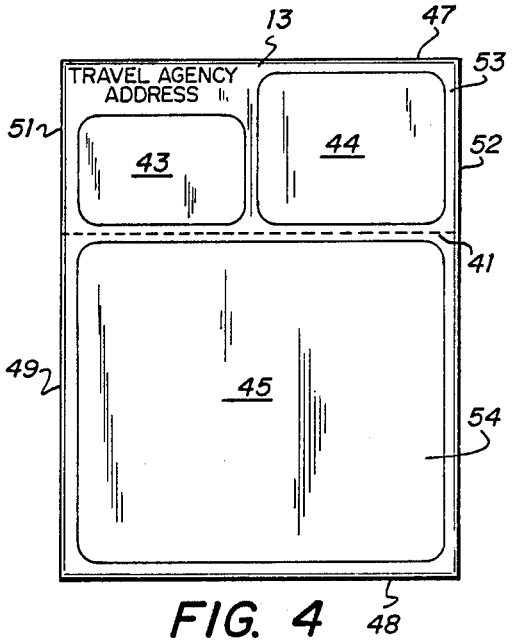
FIG. 4 is a plan view of the top face of the sheet situated immediately behind the sheet of FIG. 3.

The third sheet 13 is shown with the top side facing the viewer in FIG. 4 after separation at top edge 47 from a preceding identical sheet and from a succeeding identical sheet at bottom edge 48. Pinfeed margin strips (not shown) have also been removed from the left side edge 49 and from the right side edge 50 by tearing at perforated lines as described above. Predesignated graphic areas 43, 44 and 45 carry the same information that has been printed or typed onto the corresponding graphics areas of top sheet 11.

A transverse line 41 of perforations through sheet 13 divides the sheet into separable lower panel 54 and upper panel 53. The length of separable lower panel 54 from the bottom edge 48 to the perforation line 41 will be approximately twice the length of separable upper panel 53 from the perforation line 41 to the top edge 47. When the sheet 13 is separated at the perforation line 41 lower panel 54 provides a separate itinerary for the traveler's use and upper panel 53 remains affixed to the bottom sheet 14 of FIG. 5 to which the reader's attention is now directed.

An adhesive strip 56 borders the top edge 62 and, for the length overlaid by upper Panel 53, right edge 63 of bottom sheet 14 so that the panels 53 and 14 are joined. Left edge 51 and bottom edge 57 of upper panel 53 are not bordered by an adhesive strip and remain loose. Thus, a document pocket, open on two sides, is formed by the upper panel 53 and bottom sheet 14. Other configurations, such as joining upper panel 53 to bottom sheet 14 with adhesive bordering only one edge, or bordering three edges, may be practiced without departing from the teaching of the invention. Should the printing graphics require such, the document pocket could be located at the bottom portion of sheet 14 without departing from the teachings of the invention.

Bottom sheet 14 is scored or creased at transverse crease lines 60 and 61 for convenient folding to form a document jacket as described below. Graphic area 55 displays a duplicate copy of the itinerary information that was typed or printed onto graphic area 25 and provides the traveler with a convenient itinerary that is displayed directly onto the face of bottom sheet 14. There is no unused panel area on any sheet of the assembly and, therefore, no need for the agency employee to spend time separating and disposing of unused paper pieces. The graphic arrangement allows one continuous billing and itinerary document assembly to follow another in the manner of assemblies 10', 10 and 10'' of FIG. 2 with no paper wasted for spacer panels or unused assemblies.

Figure 5:
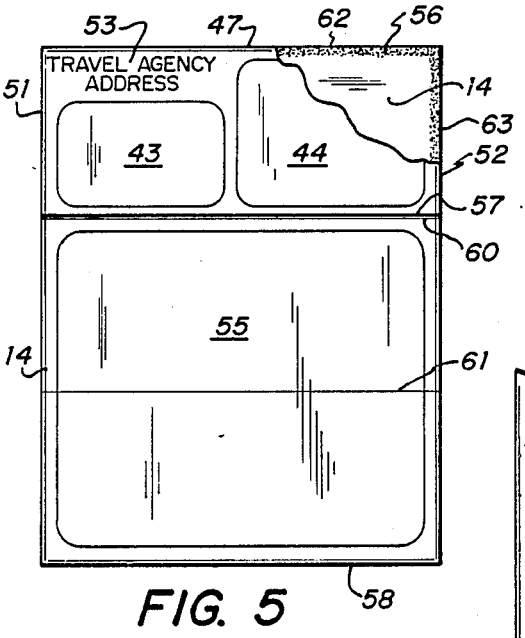
FIG. 5 is a plan view of the top face of the bottom sheet and includes a portion of the sheet of FIG. 4 affixed by adhesive along two edges.
Figure 6:
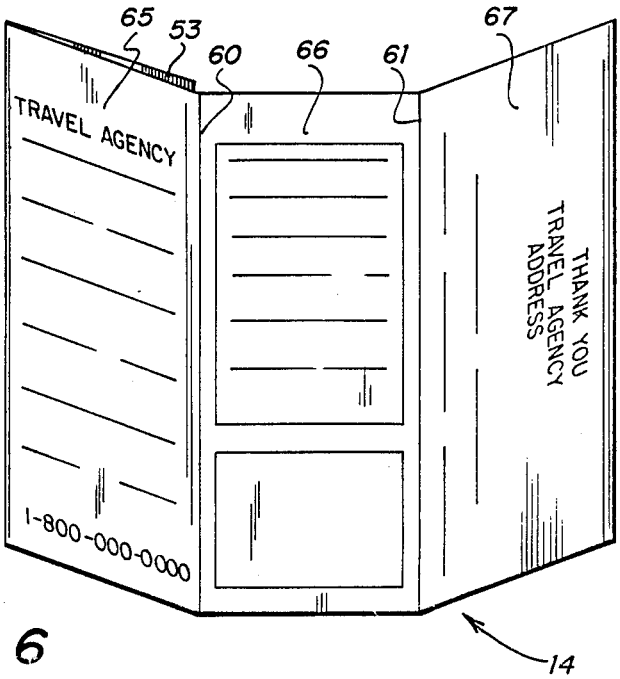
FIG. 6 is a perspective view of the reverse side of the sheet of FIG. 5, partially folded to form a document jacket.

Referring to FIG. 6 along with FIG. 5, the reverse side of bottom sheet 14 is divided into three segments 65, 66 and 67 that may display advertising and other information or may be used for notations by the agency or the traveler. A document jacket is formed by folding bottom sheet 14 inwardly at crease lines 60 and 61. Typically the length of segment 65 is slightly greater than the length of upper panel 53 to allow overlay folding of segment 66 over upper panel 53. Crease line 61 may be positioned longitudinally to allow overlay folding of segment 67 onto segment 66 or to allow segment 67 to wraparound the other segments and overlay the reverse side of segment 65. Such folding creates a secure jacket for tickets and other documents located in the pocket formed by upper panel 53 and bottom sheet 14. With the assembly 10 having approximate dimensions of eleven inch length and eight to nine inches width as previously described, folding yields a document jacket approximately eight to nine inches long by four inches wide that is convenient for carrying or mailing.

Whereas this invention is herein illustrated and described with respect to a particular embodiment, it should be realized that various changes may be made without departing from the essential contributions to the art made by the teachings hereof.

I claim:

1. A multilayered document assembly comprising a top layer, an intermediate layer and a bottom layer, each layer being a rectangular sheet having a detachable computer printer pinfeed left margin along a left longitudinal side and a detachable computer printer pinfeed right margin along a right longitudinal side, each sheet also having a perforation line for detachment of the left pinfeed margin and another perforation line for detachment of the right pinfeed margin, each sheet detachable from a preceding identical sheet by a perforation line transversely disposed across an upper side perpendicular to the left and right longitudinal sides and detachable from a succeeding identical sheet by a perforation line disposed across a lower side perpendicular to the left and right longitudinal sides; a transverse perforation line across the width of the intermediate sheet allowing detachment of a larger portion of the intermediate sheet from a smaller portion with an adhesive means partially affixing said smaller portion to the bottom sheet, thereby forming a document pocket between the bottom sheet and intermediate (layers) sheet smaller portion; the bottom (layer) sheet being divided into first, second and third segments by an upper transverse crease line and a lower transverse crease line with the first segment forming the document pocket with the smaller portion of the intermediate sheet adhered to such segment and the second and third segments displaying a carbon or carbonless copy of information printed on the top sheet of the assembly, and a document jacket being formed by folding the second and third segments over the first segment of the bottom sheet at the crease lines to cover the document pocket.

2. The assembly of claim 1 where each (layer) sheet is preprinted with graphic information and designs for entry of travel information onto designated graphic areas.

3. The assembly of claim 1 having more than one layer positioned above the intermediate layer.

4. The assembly of claim 1 where each (layer) sheet is a treated paper sheet providing for copying of information printed onto the top (layer) sheet to each (layer) sheet below.

5. The assembly of claim 1 where the adhesive means is disposed along an upper side of the bottom (layer) sheet and along an intersecting side of the bottom (layer) sheet to the extent the bottom (layer) sheet is overlayed by the smaller portion of the intermediate (layer) sheet to thereby create a pocket open on two sides.

6. The assembly of claim 1 where all sheets of the assembly are approximately eleven inches long and extend transversely in a width range of eight to nine inches from the perforation line of the pinfeed left margin to the perforation line of the pinfeed right margin and said smaller portion of the intermediate sheet adhered to the bottom sheet to form a document pocket is from three to four inches long by eight to nine inches wide.

7. The assembly of claim 4 where information printed onto an upper portion of the upper sheet overlaying the smaller portion of the intermediate sheet adhered to the bottom sheet is copied onto such smaller portion.

* * * * *